United States Patent [19]

Jarvis

[11] Patent Number: 4,614,941

[45] Date of Patent: Sep. 30, 1986

[54] RASTER-SCAN/CALLIGRAPHIC COMBINED DISPLAY SYSTEM FOR HIGH SPEED PROCESSING OF FLIGHT SIMULATION DATA

[75] Inventor: Kevin M. Jarvis, Lancing, England

[73] Assignee: The Singer Company, Binghamton, N.Y.

[21] Appl. No.: 514,419

[22] Filed: Jul. 18, 1983

[30] Foreign Application Priority Data

Oct. 10, 1982 [GB] United Kingdom ..... 8230911

[51] Int. Cl.[4] ..... G09G 1/16

[52] U.S. Cl. ..... 340/747; 340/723; 340/729; 340/802

[58] Field of Search ..... 340/720, 723, 724, 727, 340/729, 742, 747, 750, 751, 802

[56] References Cited

U.S. PATENT DOCUMENTS

| | | | |
|---|---|---|---|
| 3,792,463 | 2/1974 | Eriksson et al. | 340/751 |
| 4,232,376 | 11/1980 | Dion et al. | 340/750 |
| 4,404,554 | 9/1983 | Tweedy, Jr. et al. | 340/726 |
| 4,459,677 | 7/1984 | Porter et al. | 340/750 |
| 4,468,690 | 8/1984 | Midland | 340/750 |
| 4,475,104 | 10/1984 | Shen | 340/747 |
| 4,489,317 | 12/1984 | Shiga | 340/750 |
| 4,509,043 | 4/1985 | Mossaides | 340/747 |

OTHER PUBLICATIONS

Scientific American, Ronald D. Levine, Supercomputers, Jan. 1982, vol. 246, pp. 118–135.

*Primary Examiner*—Marshall M. Curtis
*Attorney, Agent, or Firm*—Douglas M. Clarkson

[57] ABSTRACT

A raster-scan display device (which may be part of a combined raster-scan/calligraphic display) has a store (8) which is loaded (calculators 2, 4, 5, and 7) with image data. Processing of the data to assemble and output sets of values corresponding to successive line of the display is performed by line processors (10, 11, 12, etc.): during output of one line or part-line by a processor, image data for a subsequent line or part of a line is being processed by another processor, so that a processing time in excess of one line duration is available. One application of such devices is in flight simulators.

1 Claim, 6 Drawing Figures

RASTER-SCAN/CALLIGRAPHIC COMBINED DISPLAY SYSTEM FOR HIGH SPEED PROCESSING OF FLIGHT SIMULATION DATA

The present invention relates to graphics displays. Although of general application, it is particularly applicable to visual cue presentation for flight simulations. For example, it may be required to present a display of an airfield, including features of the surrounding terrain, such as hill, buildings and airfield lighting.

Background of the Invention

In an aircraft simulator, such a display is provided by a cathode ray tube (CRT) display unit, controlled by a computer generated imagery (CGI) system, with a data base containing all of the positional data and characteristics, such as intensity or color, of the features to be displayed. The data base may be stored in a general purpose computer which also selects the required data to be displayed in any given scene.

There are two basic types of CRT display: one is a raster display, where the scene is built up by scanning lines in the manner of a conventional broadcast television picture (although it may be vertical rather than horizontal scanning). The other is the calligraphic display, which can move the electron beam of the display tube in any direction at any speed from stationary to a fast sweeping scan.

Apart from creating bright spots to represent light points, an area of the display may be evenly covered by a series of parallel scanlines. Surfaces may then be depicted by varying the combination of the color components of the video signals, generated by the CGI system, as each line is scanned.

Calculation of these signals for each scanline requires a contribution from every surface in the scene of which the scanline forms a part. The calligraphic technique allows simulataneous presentation of high intensity airfield lighting and colored areas of surfaces to create highly realistic airfield approach and landing scenes.

The raster-scan method has advantages for display of large surface areas, and a combined calligraphic/raster-scan display, in which the system alternates between the two modes at a speed such that the two displays appear simultaneous, combines the advantages of both.

Computational methods for the raster-scan display have followed one of two approaches:

(a) A pixel frame buffer consisting of two very large high speed memory units capable of storing all the color information of every smallest element (pixel) of the total display.

(b) A scanline processor capable of performing all the computational tasks necessary for each scanline in the time taken to display one line.

The pixel frame buffer method, (a) above, allows the computation of surface contributions to each pixel to be carried out for sequential surfaces and then stored in one memory while the other memory, having been filled previously, is read line by line to form the color video signals. The memory required, however, for high resolution displays (1000×1000 pixels) is very large.

It must also have a very fast cycle time resulting in a large expensive system. Typically, 32 million bits have 100 ns cycle time.

The scanline processor method, (b) above, therefore, is potentially a much cheaper method of generating the color video signals because the memory required is reduced by a factor of 1000 (for a 1000 line system).

Owing to the very short time available to select and to process every surface that may form part of the scanline, however, the scanline processor must be extremely fast and complex to allow for worst case loads to be processed.

The cost of employing either of these methods is uneconomical for a system employing a calligraphic display where much of the emphasis is placed on light point generation. In such a system, typically 1000 surfaces are required compared with full daylight systems capable of 30,000 edges).

SUMMARY OF THE INVENTION

According to the present invention, a raster-scan display device has a store (memory) for containing image data, and the display device also has processing means arranged, in operation, to process the image data to assemble and output sets of values corresponding to successive scanlines of the display. The processing means includes a plurality of processors so arranged that, in operation, during output of one line or part thereof by a processor, image data for a subsequent line or part of a line is being processed by another processor.

The processing operations are distributed between processors a line at a time, so that the processors may assemble and output successive lines in rotation. In this way, the processing time available for producing one scanline of a video signal can be increased by a factor equal to, or at least approaching, the number of individual processors used. As mentioned above, the invention is arranged for use in combined raster-scan/calligraphic display systems, although many other applications are possible.

In one preferred arrangement each processor has an input for receiving data as to the intensity and position of a plurality of cells within a scanline, processing means to write the intensity data into locations in a line buffer corresponding to the position data, and means for reading out the contents of the buffer to form one scanline of a video signal.

Where an image is to be built up from a number of surfaces, the processing means is responsive to receipt of such data for those surfaces in an order of priority to overlay successive sets of intensity data into a buffer. The arrangement of the component parts permits a wide variety of applications of varying complexity by simply adding more identical processors as increased surface capacity is required. This modular approach can achieve economical production, ease of test, diagnostic fault-finding and provides "on line" spare facility.

BRIEF DESCRIPTION OF DRAWINGS

A presently preferred embodiment of the invention will now be described, by way of example, with reference to the accompanying drawings, in which:

FIG. 4 1s a more detailed block diagram of the line processors in FIG. 1;

DETAILED DESCRIPTION

Figure 1:
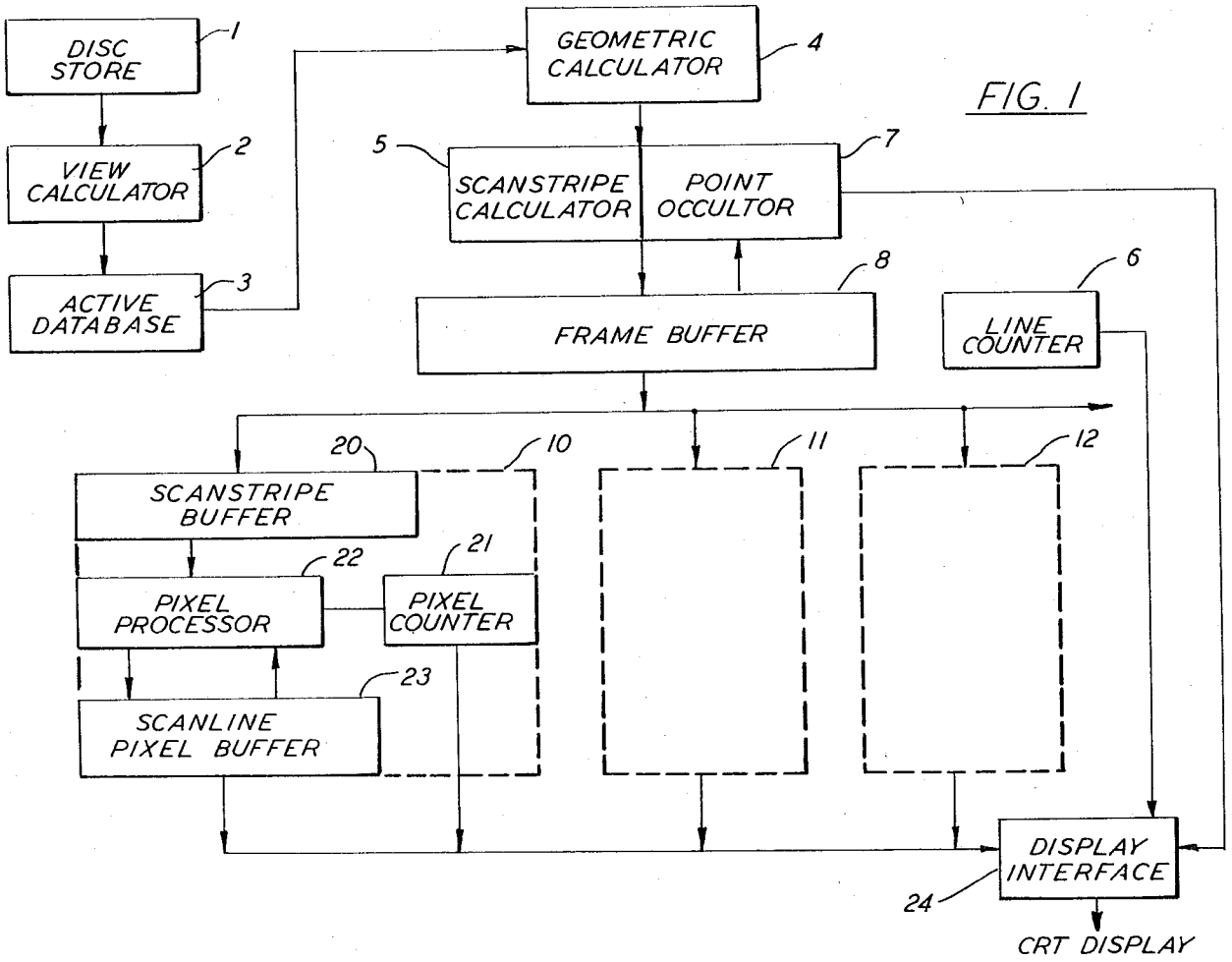
FIG. 1 is a block diagram of a display system for use in a flight simulator.

In the system shown in FIG. 1, a model of an airfield and its environment in digital form is held in a suitable mass storage memory device, such as a standard computer disk memory device 1. Data that relates to the immediate surroundings of the simulated aircraft, or other vehicle, is available to a general purpose computer system 2 and is transferred to a random access memory device which also stores the active data base information 3.

The memory device 1, in turn, is accessible directly to special purpose image processing equipment, such as a geometric calculator 4, which calculates the projected geometric positions of scene elements (i.e. light points and surface boundaries) in a two dimensional plane related to the simulator pilot in the direction of the aircraft window. The position of the data is updated at regular intervals as the aircraft moves, at an update rate sufficient to overcome any apparent stepping of the displayed scene.

A scanstripe calculator 5 then examines every surface for each line of the display scan. The position of each line is determined by a scanline counter 6, which counts in increments from zero to "N" during the raster scan where "N" is the number of lines in the raster field.

The boundary intersections of each surface with each scanline are output from the scanstripe calculator 5 followed by point data from a light point occultor 7 which serves to suppress those light points which fall behind obstructions by comparison with surfaces stored in a frame buffer 8. A light point occultor 7 is described in U.S. Pat. Ser. No. 547,531 filed Oct. 31, 1983, (which is a continuation of Ser. No. 417,795 filed Sept. 13, 1982, which, in turn, is a continuation of Ser. No. 102,706 filed Dec. 12, 1979), assigned to the same Assignee as the present invention.

Each updated position is known as a "frame", and one frame of information is held in a double frame buffer 8. One half is used for loading while the other half is being read out.

After a first half of the buffer 8 is loaded completely, the second half will begin loading while the first half is accessed. All of these operations, so far described, are known and used in existing CGI systems to produce data for scanline processing.

Referring again to FIG. 1, data from the surface frame buffer 8 is made available, via a bus 9, to a bank of scanline processors 10, 11, 12, etc., each of which comprises basically an input scanstripe buffer 20, a pixel processor 22 and an output scanline pixel buffer 23. The function of the pixel processor 22 is to build up in the output scanline pixel buffer 23 a set of intensity values corresponding to one line of the display at a time.

Each line of data that is processed by one of these scanline processors 10, 11, 12, etc., is combined in a display interface 24, which receives a line of output data from successive scanline processors in turn. The time taken for this processing will vary according to the number of surfaces in the scene, i.e. its complexity. This time may possibly exceed the time taken to output a scanline from the scanline pixel buffer 23 to the display.

The modular construction of each scanline processor 10, 11, 12, etc., enables its structure to be arranged to fit the require-ments of the scene complexity by adding additional scanline processors 10, 11, 12, etc., in parallel to share the load. Thus with the three processors, as shown in FIG. 1, accepting a line each in rotation, the time available for processing one line is three times the line duration.

Figure 2:
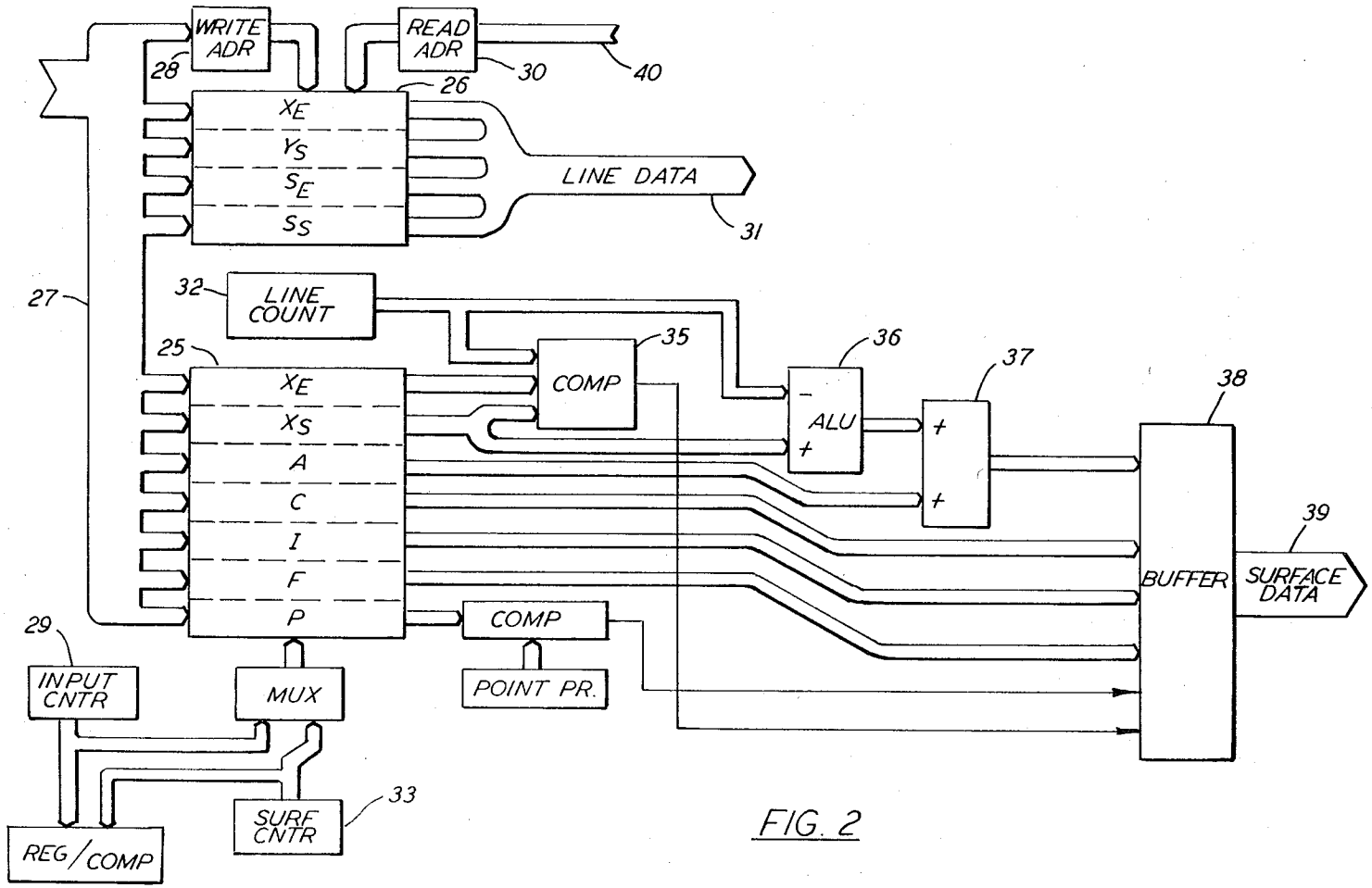
FIG. 2 is a more detailed block diagram of the "frame buffer" of FIG. 1.

Before describing the scanline processor function in more detail, the construction of the surface frame buffer 8 will be described further with reference to FIG. 2, to indicate the form of the data supplied to the scanline processors 10, 11, 12, etc.

The frame buffer 8 has two parts: a surface pointer memory 25 and a line data memory 26. The surface pointer memory 25 contains outline data for each surface in the displayed field to allow rapid selection of all surfaces forming part of a raster scanline or occulting a light point (the memory organization being in fact similar to that described in the earlier patent application referred to above).

Figure 3:
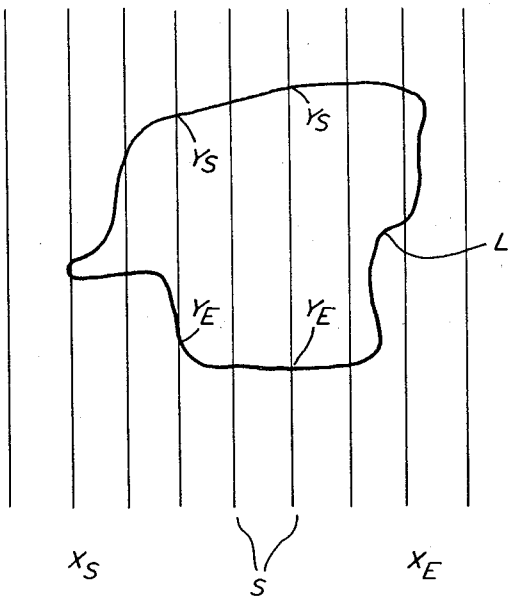
FIG. 3 illustrates various surface and line parameters.

Referring now to FIG. 3, a typical surface L is shown with scanlines "S". The memory 25 holds seven surface parameters for each of up to 256 surfaces, as follows:

| | | |
|---|---|---|
| $X_S$ | - Horizontal surface start coordinate | 12 bits |
| $X_E$ | - Horizontal surface end coordinate | 12 bits |
| A | - Line data memory start address | 14 bits |
| C | - Color/type | 10 bits |
| I | - Intensity | 8 bits |
| F | - Fade (background blend factor) | 8 bits |
| P | - Priority (used for light part occulting) | 8 bits |

The surface data are held in the memory 25 in priority order, starting with the surface nearest to the observation position, followed by more remote surfaces (which may be partially or wholly obscured by higher priority surfaces).

The line data memory 26 holds, for each surface, the detail of each raster scanline in the surface, up to a total of 16,384 line sections by using a 16K×40 bit memory, viz., the boundary intersections calculated by the scanstripe processor, as follows:

| | | |
|---|---|---|
| $Y_S$ | - Start position (lower Y coordinate) | 12 bits |
| $Y_E$ | - End position (upper Y coordinate) | 12 bits |

and also slope values, start slope $S_S$ and end slope $S_E$ (8 bits each) representing the difference between two adjacent raster scanlines for subsequent edge smoothing operations where edges are near vertical (parallel to the raster scan).

As mentioned above, each of the memories is duplicated so that while one is being loaded, the other can be accessed. For simplicity (and since this is a conventional technique), only one is shown in the drawing.

The memories are loaded via an input data bus 27, which also supplies a WRITE address to the line data memory 26 (via WRITE buffer 28). The memory capacity required for each surface varies with the size of the surface, and the start address "A" in the line data memory 26 is recorded in the surface pointer memory 25 for each surface.

The surface pointer memory 25 uses a fixed format, and its WRITE address is supplied by an input counter 29. Data is read onto a line data bus 31 from the line data memory 26 using an address READ input 30.

Data is output from the surface pointer memory 25 on a line-by-line basis. The current line number is held in a line counter 32. A surface counter 33 cycles through all of the surfaces stored in the surface pointer memory 25, i.e. addresses every location up to the number held in a register 34 containing the final contents of the input counter during the loading phase.

As each location is addressed, all of the surface parameters are output in parallel, and a check operation is performed by a comparator 35 before loading a set of parallel pipeline registers for output on a surface data bus 39. The check operation gives a positive result (and the registers are loaded) only if the line counter 32, which doubles as a register for the horizontal light point coordinates, if the line counter contents (or a point's X coordinate) lies between the start $X_S$ and end $X_E$ of the surface in the horizontal axis.

Also, the number of raster lines between the surface start $X_S$ and line counter (X) is calculated by ALU 36 from the difference between their respective horizontal positions. This difference value is added in on adder 37 to the start address "A" (in the surface pointer memory 25), and the total is loaded into a pipeline register 38 before transfer to the line processors 10, 11, 12, etc., thus giving the "pointer" to the location, in the line data memory, of the surface lines coincident with the scanline or point X coordinate.

The pipeline register 38, therefore, contains the following parameters:

| | |
|---|---|
| SDM Pointer | 14 bits |
| Color/type | 10 bits |
| Intensity | 8 bits |
| Fade | 8 bits |
| Line Check | 1 bit |

The line check will validate the pointer and will cause an increment to the counter on the line processor for each valid pointer. These pipeline registers are loaded synchronously with the pointer memory address register, at 10 MHz.

Figure 4:
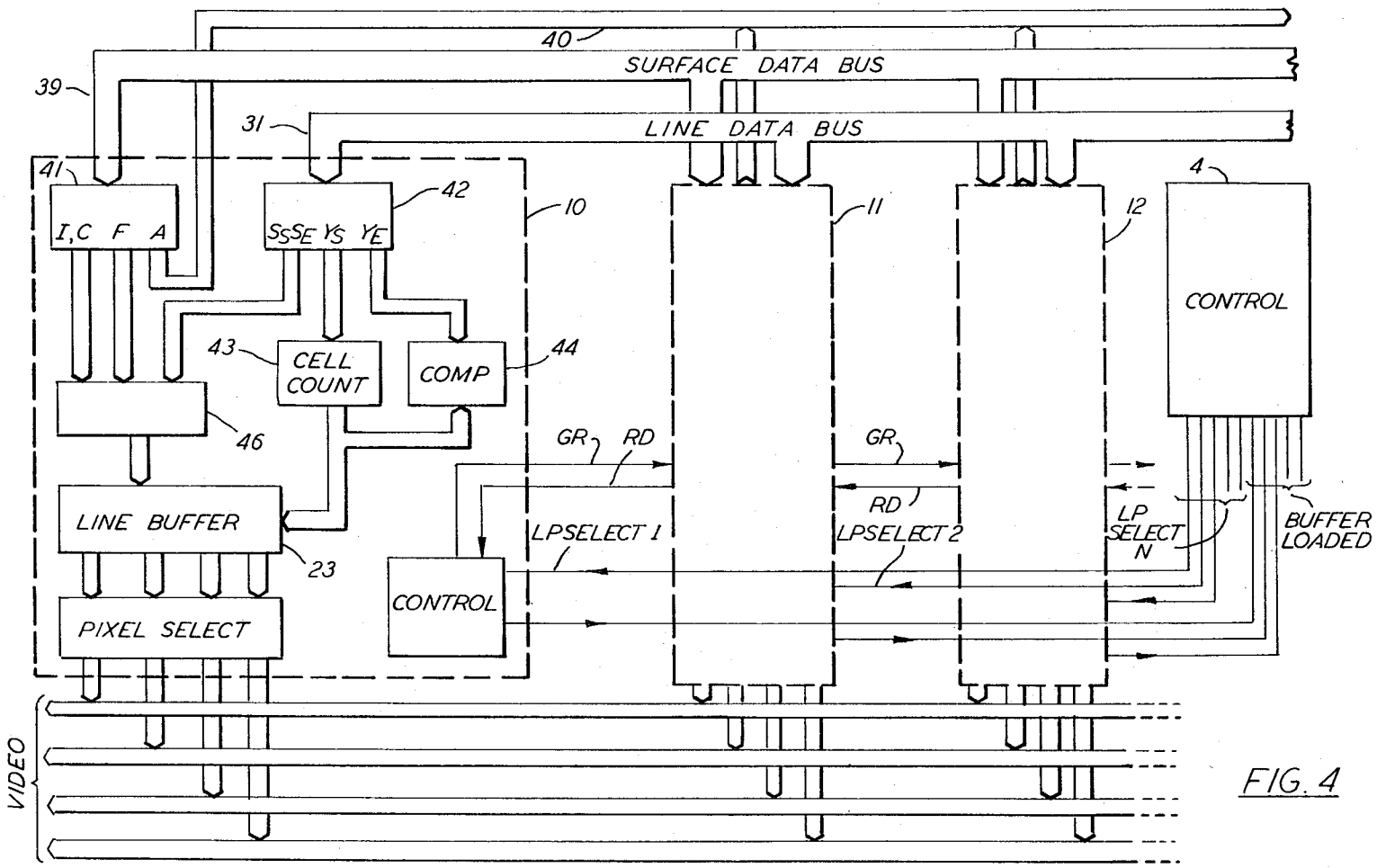

The line processor 10 is shown in detail in FIG. 4, along with sections of the surface data bus 39, the line data bus 31 and address lines 40, which together form the bus 9 of FIG. 1. As described previously, data from the surface pointer memory 25 (i.e. A,C,I,F) relevant to the current line is made available on the surface data bus 39.

This data is buffered in a last-in, first-out (LIFO) buffer 41 (FIG. 4) to allow for differences in loading and processing times; at the same time, reversing the "priority order" of the surfaces (i.e. the lowest priority surface is read out first). The address field "A" is output on the address lines 40 to read the corresponding information ($Y_S$, $Y_E$, $S_S$, $S_E$) from the line data memory 26 via the bus 31, into a FiFo buffer 42 i.e. first in, first out.

The pixel processor includes a high speed pixel counter 43 having a range from "0" (zero) to "N", dividing the scanline into "N" parts which may each have unique video levels corresponding to a unique color and intensity on the CRT. The counter 43 is loaded first from the buffer 42 with the lower boundary position $Y_S$ of the first surface and increments until the upper boundary $Y_S$ is reached (indicated by a comparator 44). Then, the pixel processor uses this counter 43 to load the scanline pixel buffer 23, which has a location for every pixel ("N" locations) in the scanline addressed by the counter 43.

As described above, with the exception of point processing tasks, the function of the line processor is to build up a set of intensity values, in the line buffer memory, for 1024 subdivisions of the line (known as pixels) each pixel being as long as the spacing between lines. The pixel is subdivided into four sub- pixels for greater resolution in the vertical axis, giving 4096 vertical steps. The line buffer is filled "bottom up", i.e. lowest priority first, so that higher priority surfaces overwrite lower ones.

Figure 5:
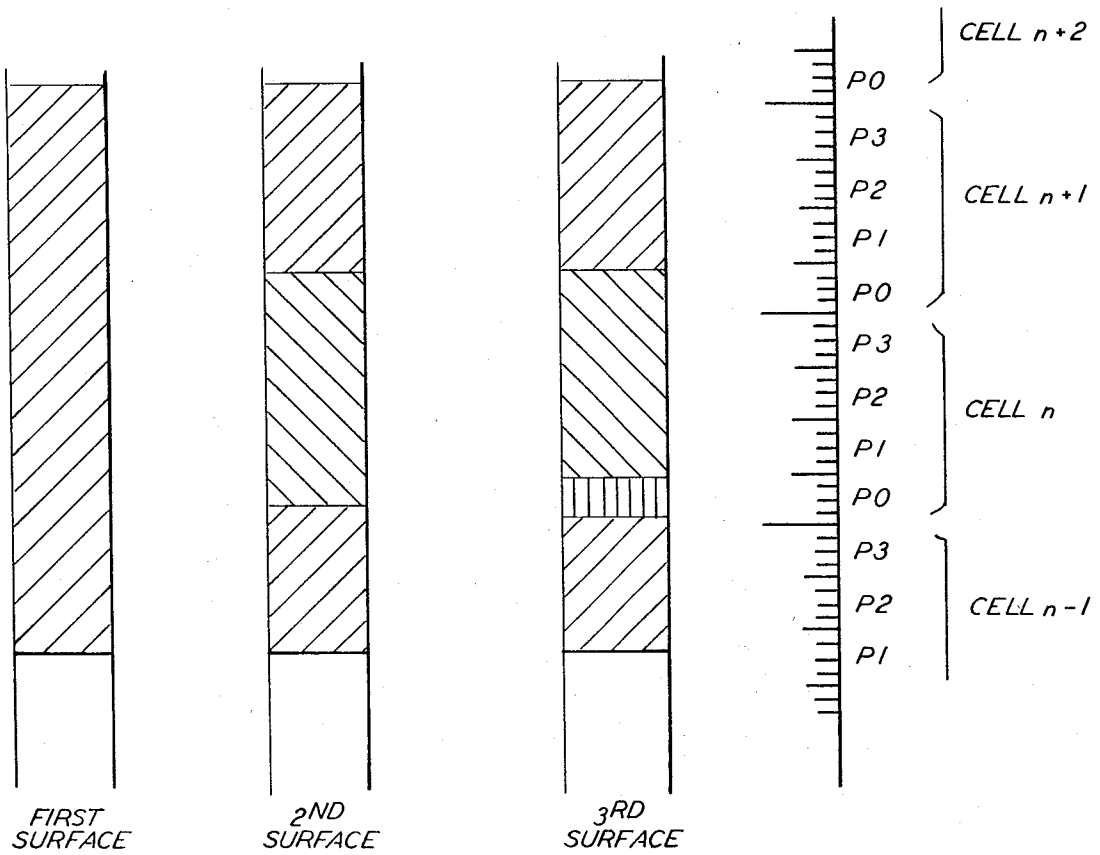
FIG. 5 is a schematic diagram illustrating the loading sequence of the line buffer.

The intensity value of each sub-pixel is loaded into the eight-bit line buffer memory 23 between and including start and end line positions (see FIG. 5). Six bits are used for intensity, and two bits are used for flags indicating surface type. In actual practice, four pixels (1 cell, 16 sub-pixels) are accessed in parallel. As described above, the line processors 10 and 11 also operate in parallel.

In the loading phase, the starting cell is loaded from the sub-pixel at the surface boundary up to the end of the cell. Subsequent cells are loaded completely with the surface intensity until the end cell, which is loaded up to the boundary sub-pixel.

FIG. 5 shows three surfaces in a section of the line buffer 23. The first surface covers 2 cells completely (n & n+1) and partially covers the start and end cells (n−1& n+2, respectively). This is overwritten by the next surface which only changes the sub-pixels covered in cell n and n+1. Finally, positions of both surfaces are overwritten by the third surface which only used 3 sub-pixels in cell n.

When the line buffer 23 has been filled, and its display cycle begins; the 256 cells are accessed sequentially. During each cell access, the four pixels are selected in turn (25ns per pixel), and the four sub-pixels in each pixel are output in parallel where they are subsequently averaged to give one quarter of the final pixel intensity to each sub-pixel.

The fade (F) and the slope ($S_S$ and $S_E$) are used by an edge smoothing logic circuit 46 which can read the contents of the scanline pixel buffer 23 in order to modify the intensity that is loaded to blend the surface with any surfaces previously loaded. This may be necessary to reduce aliassing effects or to affect surface translucency computations.

The control of the system will now be described. A common line processor control unit 47 coordinates the line processors: for each line of the scan, one line processor is selected for output by a signal "LP Select N" from the line processor control unit 47. When this signal is false, then a local control unit 48 in the relevant line processor causes that line processor to start loading the line buffer 23.

The time available allows 3.6 over-writes of the line buffer 23 (920 cells) before the line processor is due to be selected again. Completion of loading is acknowledged to the control unit 47 via an acknowledge line "Buffer loaded."

Figure 6:
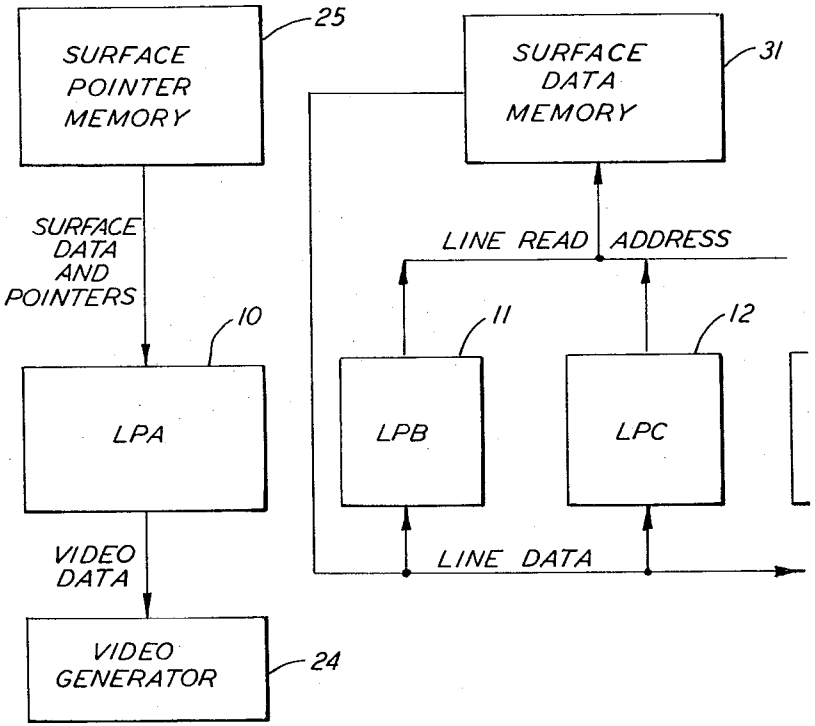
FIG. 6 illustrates the line processor data input.

As illustrated in FIG. 6, while one line processor is outputting the contents of its scanline pixel buffer 23 (FIG. 1) to the CRT display, it may also be loaded from its scanstripe calculator 5 (FIG.1). Meanwhile, the other line processors are transferring surface data from their respective buffer 42 (FIG. 4) to the respective scanline pixel buffer 23 via the pixel processor 22. Local arbitration is used between the respective line processors to allow alternate use of the address lines 40 and the line data bus 31 FIGS. 2 and 4), via grant and request lines GR and RQ (FIG. 4), in conventional manner.

The above detailed description is to be considered as illustrative only, the true spirit and scope of the invention being that defined by the appended claims.

I claim:

1. In a reater-scan/calligraphic combined display system for high speed processing of flight simulation data, the combination comprising:

(a) geometric calculator means for determining projected geometric positions of scene features to be displayed;

(b) memory means for storing image data and accessable directly by said geometric calculator means;

(c) WRITE ADDRESS buffer circuit means for supplying an address to said image data;

(d) input data bus means for connecting said image data from said geometric calculator means to said WRITE ADDRESS buffer circuit means;

(e) scanline data memory means connected to said input data bus means to hold, for each surface to be displayed, the details of each raster scanline representing such surface;

(f) surface pointer memory means connected to said input data bus means for holding a START ADDRESS in each scanline for such surface;

(g) a plurality of processor means to process said image data to build up a set of intensity values for successive scanlines of a display;

(h) said plurality of processor means connected in parallel for receiving, in rotation, one scanline of data;

(i) buffer means connected with each of said processor means for receiving and storing temporarily data defining the intensity value of a plurality of pixels within a scanline; and (j) pixel processor means for writing said intensity values into locations in said buffer means corresponding to said image data.

* * * * *